US006824210B2

(12) United States Patent
Zheng

(10) Patent No.: US 6,824,210 B2
(45) Date of Patent: Nov. 30, 2004

(54) COLLAPSIBLE CHAIR

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 0 days.

(21) Appl. No.: 10/301,059

(22) Filed: Nov. 20, 2002

(65) Prior Publication Data

US 2004/0094996 A1 May 20, 2004

(51) Int. Cl.[7] ..... A47C 4/00
(52) U.S. Cl. ..... 297/58; 297/23; 297/46
(58) Field of Search ..... 297/23, 58, 55, 297/24, 25, 46, 50, 228, 225, 229, 228.1, 42, 45, 44, 56, 16.1; 403/113, 114, 19, DIG. 13

(56) References Cited

U.S. PATENT DOCUMENTS 703,077 A * 6/1902 Nivison ..... 297/44
1,767,736 A * 6/1930 Brown ..... 248/436
1,942,112 A * 1/1934 McQuilkin ..... 297/45
2,660,224 A * 11/1953 Frisch ..... 297/23
3,621,192 A * 11/1971 Pohler ..... 219/217
4,065,172 A * 12/1977 Gawlinski ..... 297/19
4,105,244 A * 8/1978 Colby ..... 297/45
4,118,065 A * 10/1978 Watkins ..... 297/45
4,245,849 A * 1/1981 Thiboutot ..... 280/20
4,265,466 A * 5/1981 Kassai ..... 280/648
4,437,700 A * 3/1984 Elaschuk ..... 297/45
4,556,249 A * 12/1985 Kassai ..... 297/30
4,697,823 A * 10/1987 Kassai ..... 280/644
4,717,201 A * 1/1988 Barras ..... 297/16.2
5,058,950 A * 10/1991 Mann ..... 297/45
5,123,697 A * 6/1992 Szczurek ..... 297/23
5,288,098 A * 2/1994 Shamie ..... 280/642
5,570,928 A * 11/1996 Staunton et al. ..... 297/232
5,718,473 A * 2/1998 Lynch, Jr. ..... 297/16.2
5,855,409 A * 1/1999 Tseng ..... 297/35
5,897,161 A * 4/1999 Karg ..... 297/16.2
6,082,813 A * 7/2000 Chen ..... 297/16.2
6,149,238 A * 11/2000 Tsai ..... 297/411.43
6,170,907 B1 * 1/2001 Tsai ..... 297/16.1
6,296,304 B1 * 10/2001 Zheng ..... 297/45
6,364,409 B1 * 4/2002 Saul et al. ..... 297/16.2
6,382,716 B1 * 5/2002 Wu ..... 297/56
6,398,298 B1 * 6/2002 Chen ..... 297/41
6,435,607 B1 * 8/2002 Liu ..... 297/55
6,540,290 B2 * 4/2003 Liu ..... 297/45
6,547,322 B2 * 4/2003 Marx ..... 297/45
6,595,582 B1 * 7/2003 Liu ..... 297/35
6,634,705 B1 * 10/2003 Zheng ..... 297/41
2003/0006632 A1 * 1/2003 Ku ..... 297/45
2003/0015892 A1 * 1/2003 Wu ..... 297/45
2003/0020305 A1 * 1/2003 Liu ..... 297/42
2003/0071493 A1 * 4/2003 Miyagi ..... 297/16.2

* cited by examiner

*Primary Examiner*—Peter M. Cuomo
*Assistant Examiner*—Stephanie Harris
(74) *Attorney, Agent, or Firm*—Rutan & Tucker

(57) ABSTRACT

A collapsible chair has a front leg, a rear leg, a cross brace, a seat support rod, and a back rest, coupled together such that the chair collapses in a single movement. In especially preferred aspects, a collapsible chair comprises a connector that is slidably coupled to a leg and that further includes a first rotatable coupling to one end of a cross brace and a second rotatable coupling to one end of a seat support rod.

15 Claims, 2 Drawing Sheets

COLLAPSIBLE CHAIR

FIELD OF THE INVENTION

The field of the invention is collapsible furniture.

BACKGROUND OF THE INVENTION

Folding chairs are relatively popular, because they can be stored with considerably reduced space requirements when compared to non-folding chairs. Nevertheless, folding chairs still require relatively large space, since the dimension of the folding chair is generally reduced only along one space coordinate (e.g., reduced length). To further reduce the space requirement, collapsible chairs have been developed, in which further size reduction is achieved by folding the chair along at least two space coordinates (e.g., length and width). Various collapsing chairs are known in the art.

For example, Cook et al. describes in U.S. Pat. No. 5,921,621 a collapsible chair with a foldable back rest, in which the chair has four legs that support the corners of a flexible square seat. The legs are movably attached to each other at about their respective midpoints, and the seat is collapsed in width and depth by turning the legs around the midpoint. While Cooks chair is relatively easy to unfold and collapse, Cooks chair provides relatively little stability and is prone to tipping over.

Improved stability can be achieved by including slidable cross bars between the legs as described in U.S. Pat. No. 6,082,813 to Chen and U.S. Pat. No. 5,984,406 to Lee. Chen's chair advantageously collapses to a relatively compact form. However, the position of the back support is limited to a vertical position, which may not be comfortable over a prolonged period. On the other hand, Lee's chair provides an angled back rest, although it lacks a seat support entirely.

In addition to the problems of the collapsible chairs mentioned above, all or almost all of the known collapsible chairs suffer from a common disadvantage in that the seat will loose tension once the seat supports the weight of a person. Moreover, where known chairs are collapsible in a single motion, such chairs do typically fail to provide a seat support rod onto which the seat can be tensioned. Alternatively, where known chairs have a pair of seat support rods, such chairs generally require at least two folding motions (e.g., one motion in which the seat is folded upwards followed by one motion in which the seat is folded in a side-to-side movement). Therefore, there is a need to provide improved methods and apparatus for collapsible chairs.

SUMMARY OF THE INVENTION

The present invention is directed to collapsible chairs, and in particular to collapsible chairs that can be collapsed in a single movement.

In one aspect of the inventive subject matter, a collapsible chair has a front leg, a rear leg, a cross brace, a seat support rod, and a back rest, wherein the seat support rod is rotatably coupled to the front leg, and wherein the back rest is coupled to the front leg, and wherein the cross brace and the seat support rod are rotatably and slidably coupled to the rear leg in a manner such that the chair collapses in a single movement. Especially preferred modes of rotatably and slidably coupling of the cross brace and the seat support rod include a slidable connector that is slidably coupled to the rear leg and that further includes a first rotatable coupling to one end of the cross brace and a second rotatable coupling to one end of the seat support rod.

Contemplated chairs may further include a second front leg, in which the chair collapses in a single movement such that the front legs approximate each other when the seat support rod pivots towards the front leg. Alternatively or additionally, suitable configurations may further comprise a second seat support rod and a second cross brace, wherein the second cross brace is rotatably coupled to the front leg and rotatably coupled to the second seat support rod. It is generally contemplated that a seat is coupled to the seat support rod, wherein in especially preferred chairs the seat is contiguous with the back rest.

Thus, in another aspect of the inventive subject matter, a collapsible chair may have a pair of front legs, a pair of rear legs, a first pair of cross braces, a second pair of cross braces, and a pair of seat support rods. In such chairs, a seat may be coupled to the pair of seat support rods, and a back rest may be coupled to the front legs, wherein the seat is contiguous with the back rest, wherein one cross brace of the first pair of cross braces is rotatably coupled to one of the front legs, and rotatably and slidably coupled to one of the rear legs, and wherein the other of the first pair of cross braces is rotatably coupled to the other of the front legs, and rotatably and slidably coupled to the other of the rear legs. Furthermore, it is contemplated that in such chairs one cross brace of the second pair of cross braces is rotatably coupled to the one of the front legs, and rotatably coupled to one of the seat support rods, and the other of the second pair of cross braces is rotatably coupled to the other of the front legs and rotatably coupled to the other of the seat support rods.

In still further contemplated aspects of the inventive subject matter, a collapsible furniture includes a connector that is slidably coupled to a leg and that further includes a first rotatable coupling to one end of a cross brace and a second rotatable coupling to one end of a seat support rod. In particularly preferred connectors, the first rotatable coupling allows rotation of the cross brace in at least x-coordinate and y-coordinate. Alternatively or additionally, the connector may be separable into two portions, wherein the first portion comprises the first rotatable coupling and wherein the second portion comprises the second rotatable coupling.

Various objects, features, aspects and advantages of the present invention will become more apparent from the following detailed description of preferred embodiments of the invention, along with the accompanying drawings in which like numerals represent like components.

DETAILED DESCRIPTION

It is generally contemplated that a collapsible chair includes a seat coupled to a pair of seat support rods, and that the chair can be collapsed in a single motion. As used herein, the term "collapses in a single movement" or "collapses in a single motion" are used interchangeably and refer to a movement in which a user need not interrupt the collapsing motion to fasten or unfasten a connector. Thus, the term "collapses in a single movement" may also include multiple sub-movements, which may or may not be separated by a pause.

Figure 1:
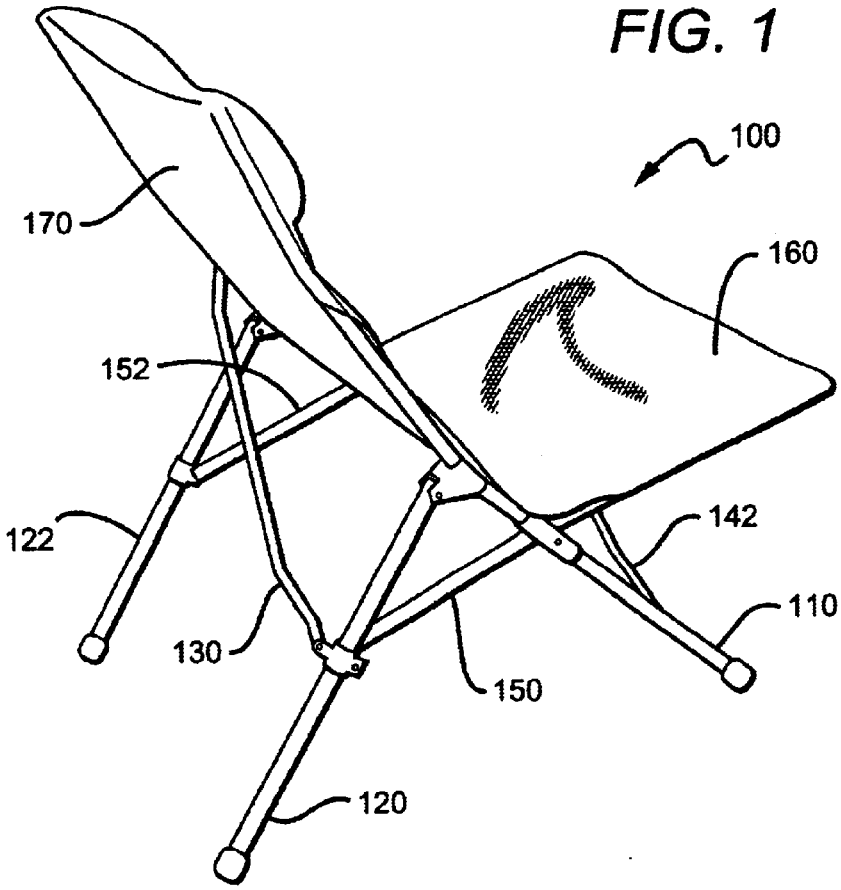
FIG. 1 is a perspective view of a collapsible chair according to the inventive subject matter.

In one aspect of the inventive subject matter, as depicted in FIG. 1, an exemplary collapsible chair 100 has a pair of front legs 110 and 112 (see also FIG. 2), a pair of rear legs 120 and 122, a first pair of cross braces 130 and 132 (not shown), a second pair of cross braces 140 and 142 (see also FIG. 2), and a pair of seat support rods 150 and 152. A tensioned seat 160 is coupled to the pair of seat support rods 150 and 152, and a back rest 170 is coupled to the front legs 110 and 112, wherein the seat is contiguous with the back rest. One cross brace 130 of the first pair of cross braces is rotatably coupled to one of the front legs 112, and rotatably and slidably coupled to one of the rear legs 120, and the other of the first pair of cross braces 132 (not shown) is rotatably coupled to the other of the front legs 110, and rotatably and slidably coupled to the other of the rear legs 122. One cross brace 140 of the second pair of cross braces is rotatably coupled to the one of the front legs 112, and rotatably coupled to one of the seat support rods 150, and the other of the second pair of cross braces 142 is rotatably coupled to the other of the front legs 110 and rotatably coupled to the other of the seat support rods 152.

Figure 2:
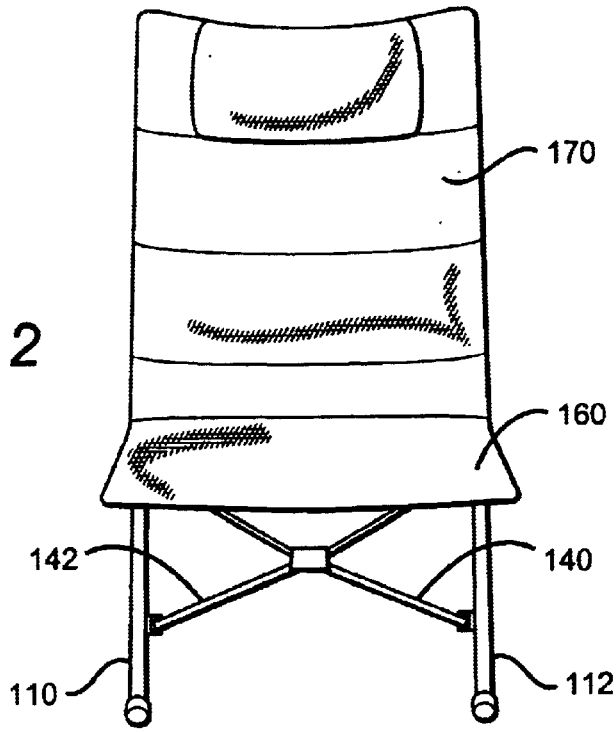
FIG. 2 is a front view of the collapsible chair of FIG. 1.

It is generally contemplated that the rear leg of the chair according to FIG. 1 is rotatably or pivotably coupled to the front leg (and most preferably via a hinge), while the coupling of the seat support rod to the front leg is preferably rotatably (and most preferably via a common axis (e.g., using a pin or rivet)). Similarly, where the cross braces of the first set of cross braces are rotatably coupled to the rear legs, it is generally preferred that the coupling allows for pivoting movement of the cross brace towards the front leg and towards the rear leg on the opposite side. Likewise, where the cross braces of the second set of cross braces are rotatably coupled to the front legs, it is generally preferred that the coupling allows for pivoting movement of the cross brace towards the front leg. Rotatable and slidable coupling of the cross braces in both first and second set of cross braces may be imparted by a sliding sleeve that further includes a pivot point for the cross brace. For better illustration of the chair of FIG. 1, FIG. 2 depicts a front view of the chair of FIG. 1.

Figure 3:
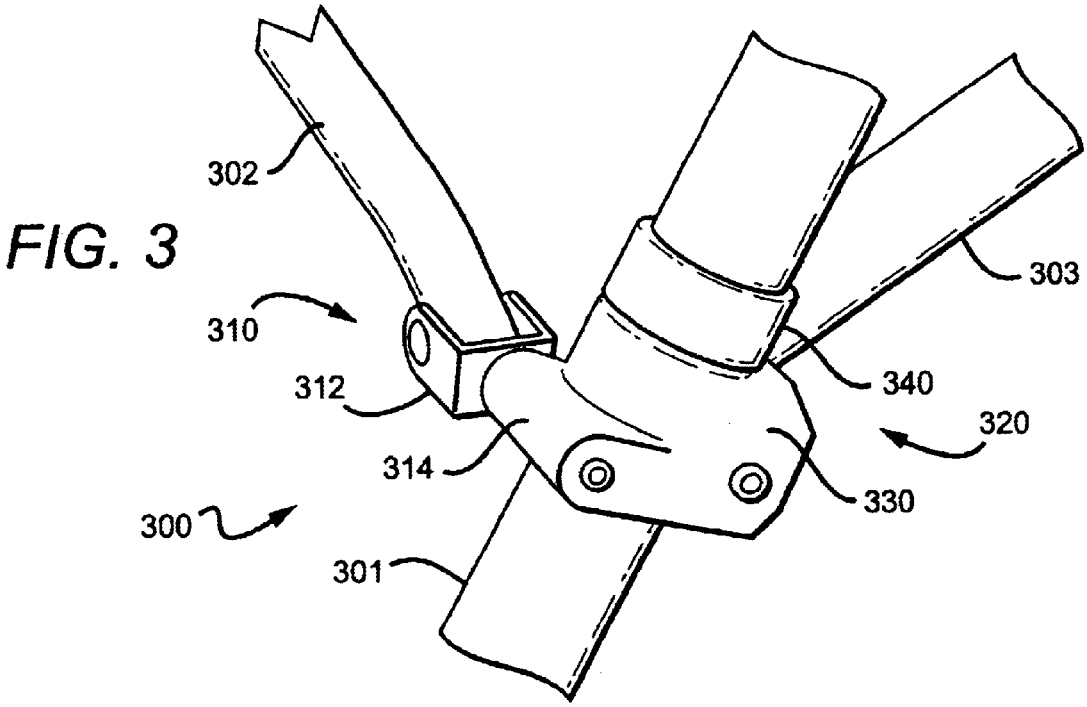
FIG. 3 is one perspective view of a connector in a collapsible furniture according to the inventive subject matter.

While the manner of rotatable and slidable coupling may be performed in numerous ways (see also below), it is especially preferred that the rotatably and slidably coupling of the first pair of cross braces and the seat support rods are facilitated by a slidable connector that is (a) slidably coupled to the rear leg, (b) further includes a first rotatable coupling to one end of the cross brace, and (c) still further has a second rotatable coupling to one end of the seat support rod. An exemplary connector that is slidably coupled to a leg and that further includes a first rotatable coupling to one end of a cross brace and a second rotatable coupling to one end of a seat support rod is depicted in FIG. 3.

Figure 4:
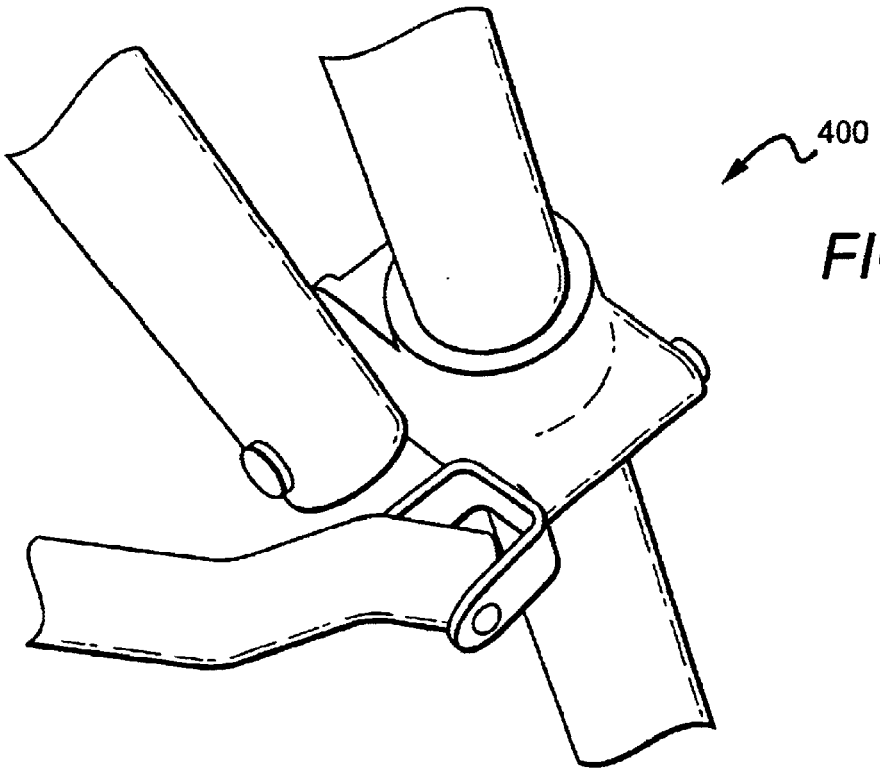
FIG. 4 is another perspective view of the connector of FIG. 3.

Here, an exemplary connector 300 is slidably coupled to the rear leg 301 of a collapsible chair. The connector 300 further includes a first rotatable coupling 310 to one end of a cross brace 302, and a second rotatable coupling 320 to one end of a seat support rod 303. In especially preferred aspects of such connectors, the first rotatable coupling 310 includes a first element 312 and a second element 314, wherein the first element 312 allows rotation of the cross brace around a first axis and wherein the second element 314 allows rotation of the cross brace around a second axis. Thus in such configurations, the first rotatable coupling allows rotation of the cross brace in at least two orientations (i.e., x-coordinate and y-coordinate). Where appropriate, it should be recognized that the connector may integrate both first and second rotatable couplings 310 and 320 in a single connector body. However, it is also contemplated that the connector 300 may be separable into two portions 330 and 340, wherein the first portion 330 comprises the first rotatable coupling 310 and wherein the second portion 340 comprises the second rotatable coupling 320. An alternative view of the connector element of FIG. 3 is depicted in FIG. 4 (connector element 400). Alternatively, it should be appreciated that the slidable connection may be replaced by a telescoping connection (e.g., a telescoping rear leg in which on end of the cross brace and one end of the seat support rod are fixedly coupled to a telescoping rear leg). A typical telescoping coupling is described in my copending PCT application with the serial number PCT/US00/33112, which was filed Dec. 05, 2000, and which is incorporated by reference herein.

With respect to the materials that can be employed for the manufacture of contemplated connectors, it should be recognized that all materials are deemed suitable for use herein, however, particularly preferred materials include metals (e.g., aluminum, iron, etc.), metal alloys, carbon, synthetic polymers (e.g., HDPE, PVC, etc.), and all reasonable combinations thereof. Furthermore, it should be appreciated that numerous rotatable couplings may be employed in contemplated connectors. For example, rotation may be achieved by using an axis, a ball joint, or a tie rod end (and where rotation around at least two orientations is desired, any combination of the above mentioned manners). Similarly, where alternative slidable couplings are preferred, such couplings may be done by telescoping elements, sliding gears, or sliding guides moving along a corresponding groove, etc.

In still further aspects of the inventive subject matter, it is contemplated that the seat and the back rest are fabricated from a weather resistant material, preferably a woven synthetic polymer (e.g., Nylon) and is uniformly colored (e.g., blue). Particularly preferred seats have a width of about 21 inches and an overall length of about 24 inches. However, it should be appreciated that various alternative materials, colors, and sizes are also appropriate.

For example, alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, or no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 21 inches, and suitable widths include 21–24, 24–30, and 30–40 inches, and wider, but also 18–21, 14–18, and 8–14 inches, and narrower. Likewise, the length of appropriate seats may vary between 20–42, 15–10, and 12–15 inches and less, but also between 24–27, 27–30, and more. It should further be appreciated that contemplated seats may also be tapered from the front end to the back end, or vice versa.

With respect to the back rest it is contemplated that the back rest is fabricated from the same material as the seat, and that the back rest is removably or permanently coupled to the seat (e.g., sewed, coupled with a zipper, etc.). Thus, it is preferred that the back rest has a width of about 21 inches. A preferred height of the back rest is about 18 inches. With respect to the material and color, it is contemplated that the same considerations as for the seat apply. It is further contemplated that the width and height of suitable back rests may vary, and that width and height will depend among other things on the person's size and the number of persons to be seated in the chair. Thus, alternative back rests may have a width between 18–12 inches and less, but also between 18–22 and more. Similarly, contemplated back rests may have a height between 12–18 inches and less, but also between 18–25 inches and more.

It is generally contemplated that the seat and the back rest may be coupled to the front legs and seat support rods in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadably securable elements (e.g., laces threaded through rings). Permanent couplings include sewed or glued elements. For example, the back rest may permanently coupled to the chair via a rivet. On the other hand, the top end of the back rest may be temporarily coupled to the front legs via ring-shaped openings slided over the top ends of the front legs. It is further particularly preferred that the seat and the back rest are coupled together.

It should further be appreciated that the attachment of the seat and/or the back rest to the chair may be directly or indirectly attached. As used herein, the term "direct" attachment means that the seat and/or the back rest are in immediate contact with the supporting structure, whereas the term "indirect" means that an additional element connects the seat and/or back rest with the supporting structure. For example, the seat may be directly attached to the seat support rods via a slidable pouch. Alternatively, the seat may be indirectly coupled to the seat support rods via a ring-shaped opening in the seat that slidably engages with the rods.

With respect to the front and rear legs, the seat support rods, and the cross braces of contemplated chairs, it should be appreciated that all of these elements may be manufactured from various materials, including metals, metal alloys, natural and synthetic polymers, and any reasonable combination thereof. However, it is preferred that the legs, seat support rods, and cross braces are manufactured from black anodized aluminum tubing with a wall strength of about 1/32 inch and an outer diameter of approximately ½ inch. Preferred alternative materials include stainless steel, fiberglass, and wood.

Where one of the legs, seat support rods, and cross braces is pivotably coupled to another one of the legs, seat support rods, and cross braces, it is generally contemplated that all known manners of rotatably coupling are suitable for use in conjunction with the teachings presented herein. For example, appropriate manners of rotatably coupling include coupling of two elements via a common axis, coupling via a hinge wherein the hinge may or may not have a slidable connection to another element, coupling via a ball bearing, etc. Similarly, where one of the legs, seat support rods, and cross braces is slidably coupled to another one of the legs, seat support rods, and cross braces, all known slidable couplings are contemplated to be appropriate, and include a sliding sleeve, slide rails, guiding rings, etc.

Furthermore, it should be appreciated that the coupling may vary depending on the particular configuration of contemplated chairs. For example it is contemplated that all of the couplings may be rotatable and slidable. Alternatively, where slidable couplings are less desirable, alternative couplings may be employed and suitable couplings especially include temporary couplings such as snap connectors, connectors that are secured with a pin or other removable element, etc. In still further alternative aspects of the inventive subject matter, the coupling may be done via an intermediate rod, that rotatably couples two elements together (e.g., the intermediate rod that couples the front leg to the rear leg in FIG. 2). Further aspects, configurations, and methods of coupling are disclosed in my copending PCT application with the serial number PCT/US00/41981 (filed Nov. 07, 2000), which is incorporated by reference herein.

Thus, viewed from another perspective, a collapsible chair may comprise a front leg, a rear leg, a cross brace, a seat support rod, and a back rest, wherein the seat support rod is rotatably coupled to the front leg, wherein the back rest is coupled to the front leg, and wherein the cross brace and the seat support rod are rotatably and slidably coupled to the rear leg in a manner such that the chair collapses in a single movement.

In especially preferred aspects of such collapsible chairs, the rotatably and slidably coupling of the cross brace and the seat support rod are facilitated by a slidable connector that is slidably coupled to the rear leg and that further includes a first rotatable coupling to one end of the cross brace and a second rotatable coupling to one end of the seat support rod. Contemplated chairs may further comprise a second front leg and collapse in a single movement such that the front legs approximate each other when the seat support rod pivots towards the front leg. A second seat support rod and a second cross brace may be included in such chairs, wherein the second cross brace is rotatably coupled to the front leg and rotatably and slidably coupled to the second seat support rod. With respect to the seat and the back rest, the same considerations as discussed above apply.

It should be especially appreciated that in contemplated configurations of collapsible chairs, the seat is tensioned when the first and the second front legs move apart, and that the seat remains substantially tensioned when the seat supports a person. The term "tensioned seat" means that the seat is substantially level when the chair is in the open configuration, wherein the term "substantially level" means that the vertical distance between any point of the seat and the seat support rod is no more than one 0.75 inch, more preferably no more than 0.5 inch, and most preferably no more than 0.25 inch. The term "open configuration" refers to the configuration of the collapsible chair in which the front legs have a maximum distance from each other when the chair is opened using reasonable force (i.e. without damaging the mechanical structure). The term "remains substantially tensioned" means that the vertical distance between the lowest point of the seat and the seat support rod increases no more than one inch, preferably no more than 0.75 inch, more preferably no more than 0.5 inch, and most preferably no more than 0.25 inch. Thus, it should be recognized that the tension of the seat is predominantly determined by the firmness of the material of the seat.

While not whishing to be bound by a particular theory, it is contemplated that the tension in the seat remains substantially tensioned due to mechanically coupling an approximating movement of the seat support rods with a simultaneous movement of at least one of the rear legs relative to the front leg and a movement of the front legs relative to each other. Viewed from another perspective, it should be recognized that while all or almost all of the prior art chairs with a seat support rod require at least two separate folding operations to collapse the chair, contemplated collapsing chairs are folded in a single movement. Moreover, it should be recognized that contemplated modes of coupling the front leg with the rear leg and the seat support rod prevent loss of tension of the seat when a person is supported by the chair.

Thus, specific embodiments and applications of collapsible chairs have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Thus, specific embodiments and applications of collapsible chairs have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair, comprising a front leg, a rear leg, a first cross brace, a second cross brace, a seat support rod, and a back rest, wherein the seat support rod is rotatably coupled to the front leg, wherein the back rest is coupled to the front leg, wherein the second cross brace is rotatably coupled to the front leg and the seat support rod, and wherein the first cross brace and the seat support rod are rotatably and slidably coupled to the rear leg in a manner such that the chair collapses in a single movement.

2. The collapsible chair of claim 1 wherein the rotatably and slidably coupling of the cross brace and the seat support rod are facilitated by a slidable connector that is slidably coupled to the rear leg and that further includes a first rotatable coupling to one end of the cross brace and a second rotatable coupling to one end of the seat support rod.

3. The collapsible chair of claim 2 further comprising a second front leg, and in which the chair collapses in a single movement such that the front legs approximate each other when the seat support rod pivots towards the second front leg.

4. The collapsible chair of claim 3 further comprising a second seat support rod and a second cross brace, wherein the second cross brace is rotatably coupled to the front leg and rotatably and slidably coupled to the second seat support rod.

5. The collapsible chair of claim 4 further comprising a seat coupled to the seat support rod, and wherein the seat is contiguous with the back rest.

6. The collapsible chair of claim 5 wherein the front leg is manufactured from aluminum and the back rest comprises a weather resistant fabric.

7. A collapsible chair, comprising:

a pair of front legs, a pair of rear legs, a first pair of cross braces, a second pair of cross braces, and a pair of seat support rods;

a seat coupled to the pair of seat support rods, and a back rest coupled to the front legs, and wherein the seat is contiguous with the back rest;

wherein one cross brace of the first pair of cross braces is rotatably coupled to one of the front legs, and rotatably and slidably coupled to one of the rear legs, and wherein the other of the first pair of cross braces is rotatably coupled to the other of the front legs, and rotatably and slidably coupled to the other of the rear legs; and wherein one cross brace of the second pair of cross braces is rotatably coupled to the one of the front legs, and rotatably coupled to one of the seat support rods, and wherein the other of the second pair of cross braces is rotatably coupled to the other of the front legs and rotatably coupled to the other of the seat support rods.

8. The collapsible chair of claim 7 wherein each of the pair of seat support rods is rotatably and slidably coupled to the rear legs.

9. The collapsible chair of claim 8 wherein the rotatably and slidably coupling of the first pair of cross braces and the seat support rods are facilitated by a slidable connector that is slidably coupled to the rear legs and that further includes a first rotatable coupling to one end of the cross brace and a second rotatable coupling to one end of the seat support rod.

10. The collapsible chair of claim 9 wherein the seat is a tensioned seat.

11. The collapsible chair of claim 1, further comprising a connector that is slidably coupled to the rear leg and that further includes a first rotatable coupling to one end of the first cross brace and a second rotatable coupling to one end of the seat support rod.

12. The collapsible chair of claim 11 wherein the first rotatable coupling allows rotation of the cross brace in at least x-coordinate and y-coordinate.

13. The collapsible chair of claim 11 wherein the connector is separable into two portions, wherein the first portion comprises the first rotatable coupling and wherein the second portion comprises the second rotatable coupling.

14. The collapsible chair of claim 11 wherein the furniture is a collapsible chair.

15. The collapsible chair of claim 11 wherein at least part of the connector is manufactured from a metal or a polymer.

* * * * *